US006102080A

United States Patent [19]

Hockemeyer et al.

[11] Patent Number: 6,102,080

[45] Date of Patent: Aug. 15, 2000

[54] LIFTING HEALD

[75] Inventors: Kurt Hockemeyer; Christoph Schwemmlein, both of Borken-Weseke, Germany

[73] Assignee: Klocker-Entwicklungs GmbH, Borken-Weseke, Germany

[21] Appl. No.: 09/386,570

[22] Filed: Aug. 31, 1999

Related U.S. Application Data

[63] Continuation-in-part of application No. PCT/DE98/00256, Jan. 29, 1998.

[30] Foreign Application Priority Data

Mar. 4, 1997 [DE] Germany ..... 297 03 896

[51] Int. Cl.[7] ..... D03C 7/00; D03D 47/44

[52] U.S. Cl. ..... 139/52

[58] Field of Search ..... 139/52, 51, 54

[56] References Cited

U.S. PATENT DOCUMENTS

| | | | |
|---|---|---|---|
| 4,967,802 | 11/1990 | Klocker | 139/51 |
| 4,987,928 | 1/1991 | Gaisser | 139/52 |
| 5,040,571 | 8/1991 | Klocker et al. | 139/52 |

FOREIGN PATENT DOCUMENTS

| | | |
|---|---|---|
| 282 874 | 3/1988 | European Pat. Off. . |
| 371 257 | 3/1988 | European Pat. Off. . |
| 0282874 | 9/1988 | European Pat. Off. . |
| 0566163 | 10/1993 | European Pat. Off. . |
| 3818680 | 10/1989 | Germany . |
| 19505835 | 5/1996 | Germany . |

*Primary Examiner*—Andy Falik
*Attorney, Agent, or Firm*—Thomas R. Vigil

[57] ABSTRACT

A lifting heald assembly is used in a device which forms a leno selvedge on a fabric or hosiery. The heald assembly comprises two lifting healds and one half heald alternately taken along by the lifting healds. Each lifting heald has, in the area of one end, at least one first magnet for guiding the half heald and has a web for taking along the half heald. The spacing between the web and the magnet corresponds approximately to the length of the half heald's legs and the lifting heald (2, 3) is provided with at least one second magnet (61, 62) that is arranged in or on the lifting heald (2, 3) and longitudinally spaced from the first magnet (41, 42) in the direction of the web (23).

4 Claims, 3 Drawing Sheets

LIFTING HEALD

CROSS-REFERENCE TO RELATED APPLICATIONS

This application is a Continuation-In-Part of PCT application No. PCT/DE98/00256 filed Jan. 9, 1998 for: LIFTING HEALD which claims priority from German Application No. 297 03 896.6 filed Mar. 4, 1997 for: LIFTING HEALD.

BACKGROUND OF THE INVENTION

1. Field of the Invention

The present invention relates to a lifting heald for a device intended to form a leno selvedge on a fabric or hosiery with two lifting healds and one half heald alternately taken along by the lifting healds, whereas the lifting heald has, in the area of the one end, at least one magnet for guiding the half heald and a web for taking along the half heald, whereas the spacing between the web and the magnet approximately corresponds to the length of the half heald's legs.

2. Description of the Prior Art

A lifting heald as mentioned above is known out of DE-PS 38 18 680. The device for forming a leno selvedge hereby consists of two lifting healds arranged on two alternately moved heald frames of a mechanical loom. The device for forming a leno selvedge also has a half heald that is alternately taken along by the movement of the lifting healds. The half heald has two legs converging at their upper end into an eye intended to guide a stationary thread. Such a half heald is made of a metallic material.

Each lifting heald has at least one magnet at its lower end. The magnet causes in turn each of the lifting healds to take along the half heald in a controlled way, the magnetic force making sure that the half heald is held by the lifting heald during their common movement. This principle is—as already explained—known out of DE-PS 38 18 680. The half heald is taken along by the lifting heald and by a web arranged in the lifting heald, the half heald sitting with its eye located at its upper end on the web during the movement it executes together with each of the lifting healds.

The lifting heald was found to indent in the area of the web. This is essentially due to the big number of strokes of 1200 and more wefts that are causing the half heald to strike with very high velocity and with correspondingly high energy onto the web. In order to avoid such an indentation it has already been suggested to insert in the lifting heald underneath the magnet a stopper for the half heald's leg. The wear in the area of the web could thus considerably be reduced and the service life of the lifting heald considerably lengthened. Nevertheless, even with this stopper, the service life still was too short, particularly when taking into consideration the increasing number of strokes in the mechanical looms.

SUMMARY OF THE INVENTION

The object of the present invention is therefore to provide a lifting heald of the type mentioned above that increases the service life even with very fast running mechanical looms.

The solution of this object is to provide the lifting heald with at least one second magnet that is arranged in the lifting heald at some distance to the first magnet in direction of the web. That means that the lifting heald has at least two magnets arranged one above the other, whereas the leg of the half heald, which is—as already explained—made of magnetic metal, is attracted by the second upper magnet. Due to the magnetic force exerted by the magnet onto the half heald's leg and, subsequently, to the friction of the half heald's leg on the lifting heald or on the magnet, the half heald is braked down, coming to sit onto the web with reduced speed.

According to an embodiment the lifting heald has two legs, whereas the one leg of the lifting heald is provided with a slot, the magnets being arranged in the wall of the lifting heald's leg forming the slot. This clearly shows that the magnets are exerting their force laterally onto the half heald's legs. The magnetic force of the second upper magnet and thus the braking effect of this magnet onto the half heald naturally has to correlate with the number of strokes of the mechanical loom. That means that a big number of strokes conditions a big magnetic force. But the magnetic force of the second upper magnet has always to be calculated so that the half heald's legs are still reaching the area of the lower magnet, since otherwise the half heald could no longer be guided. This would entail that the leno thread, departing from one side of the half heald, would no longer reliably reach the other side of it during the alternate movement of the lifting healds. That means that usually the second magnet is provided with a smaller magnetic force than the first one, which is the lower one when mounted.

According to a preferred characteristic of the invention, two braking magnets are facing each other in each wall of the lifting heald's leg. It is thus guaranteed that at least one of the two magnets is requesting the help of the half heald's leg in order to achieve the slowing down procedure. The force of friction is hereby irrespective of the speed. Particularly when using ferromagnetic material for the half heald's legs, the slowing down procedure is caused by the fact that the magnetic field between the two magnets facing each other is changed. The force of attraction is hereby proportional to the product of field strength and change of field strength. It thus exclusively depends on the position of the magnets and of the half heald relative to each other.

It has to be noted that, when two magnets are facing each other, a slowing down also takes place due to the production of eddy currents. The forces arising hereby are increasing with the speed with which the half heald's legs are guided through the area of the two magnets facing each other. A braking by means of eddy current is only possible on the condition that the half heald's material is electrically conducting and that it is—as already explained—guided through the magnetic field.

Magnetization losses of hard magnetic material (with rectangular hysteresis loop) may also be used to achieve a braking effect, whereas the braking effect is proportionally increasing with the number of magnetic reversals in one path or in a given period of time. The braking effect is thus also proportional to the speed with which the half heald's leg is moving within the magnetic field of the two magnets facing each other. The half heald has hereby to be made of hard magnetic material and the leg has to be provided, in the area of the magnets, by means of a determined field configuration, with a particularly high number of magnetic poles for the change of flow direction. Thus, the highest possible number of magnetic reversals may take place when passing the magnets.

The invention is explained in more details according to the drawing.

DESCRIPTION OF THE PREFERRED EMBODIMENT(S)

Figure 1:
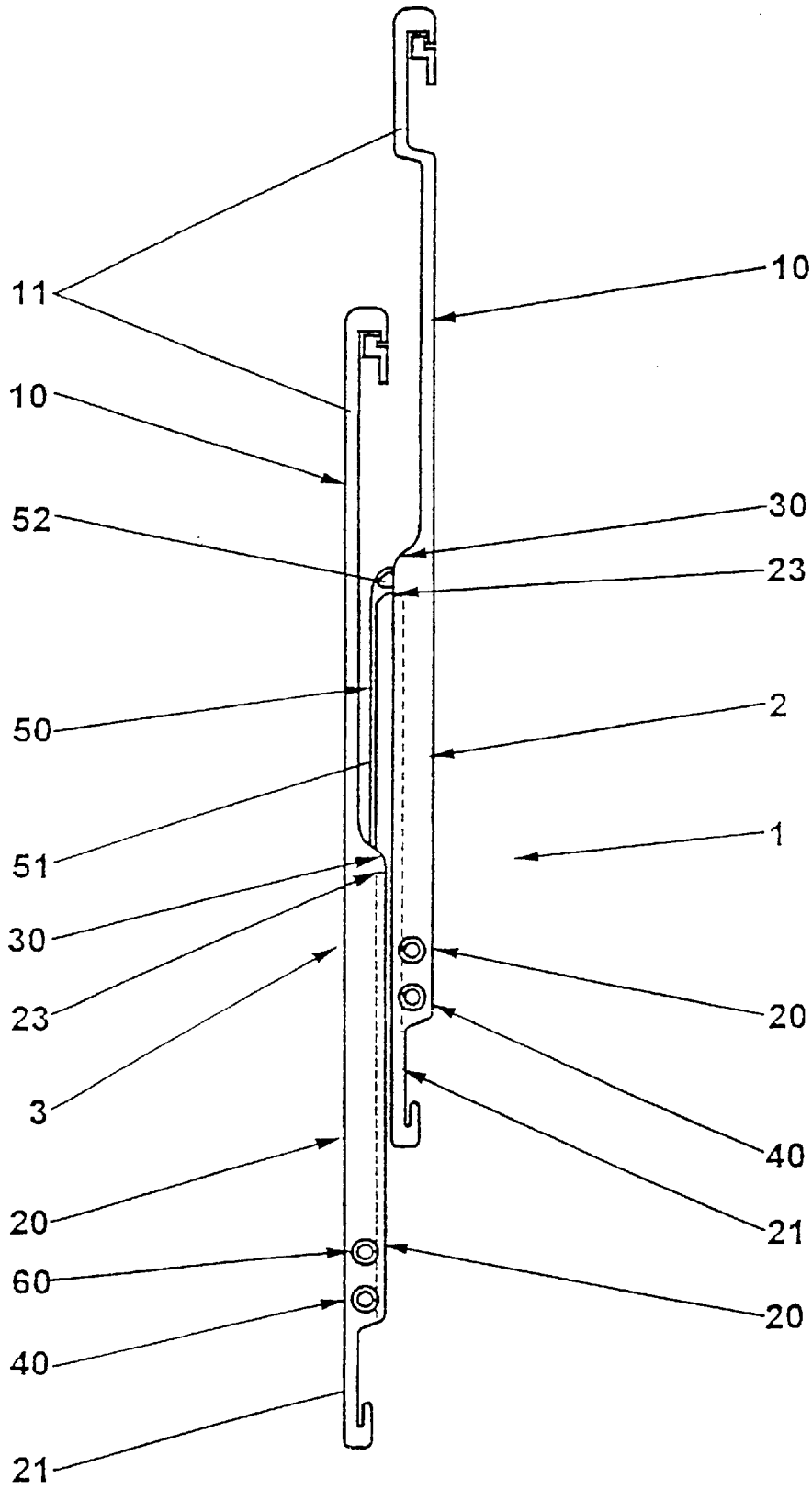
FIG. 1 shows the complete device for forming a leno selvedge with two lifting healds and one half heald.
Figure 2:
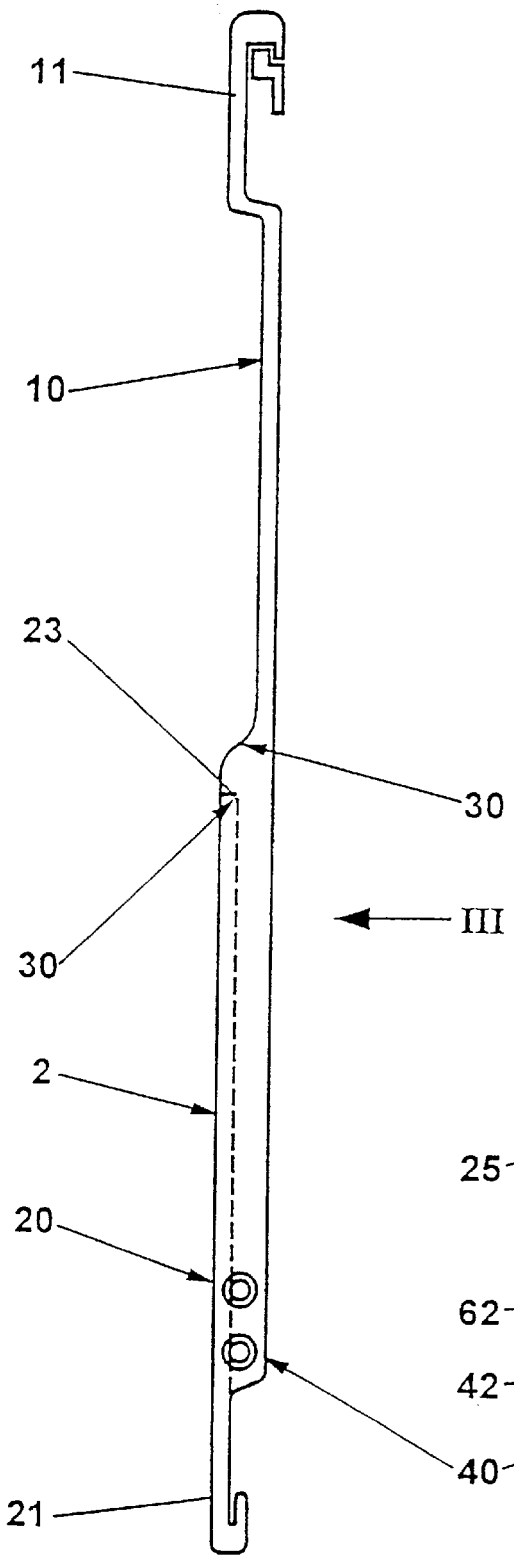
FIG. 2 shows a lifting heald in a lateral view.

The device 1 for forming a leno selvedge has two lifting healds 2, 3 that may be connected to heald frames moved alternately and that are alternately taking along the half heald 50. The principle of this function is for example described in DE-PS 38 18 680. Reference to this document is explicitely made.

Each lifting heald 2, 3 essentially consists of two legs 10 and 20, each of the legs 10 and 20 being provided with a hook-like element 11 and 21 permitting their fastening on the rods (not shown) supporting the alternately moving healds of the mechanical loom.

Figure 4:
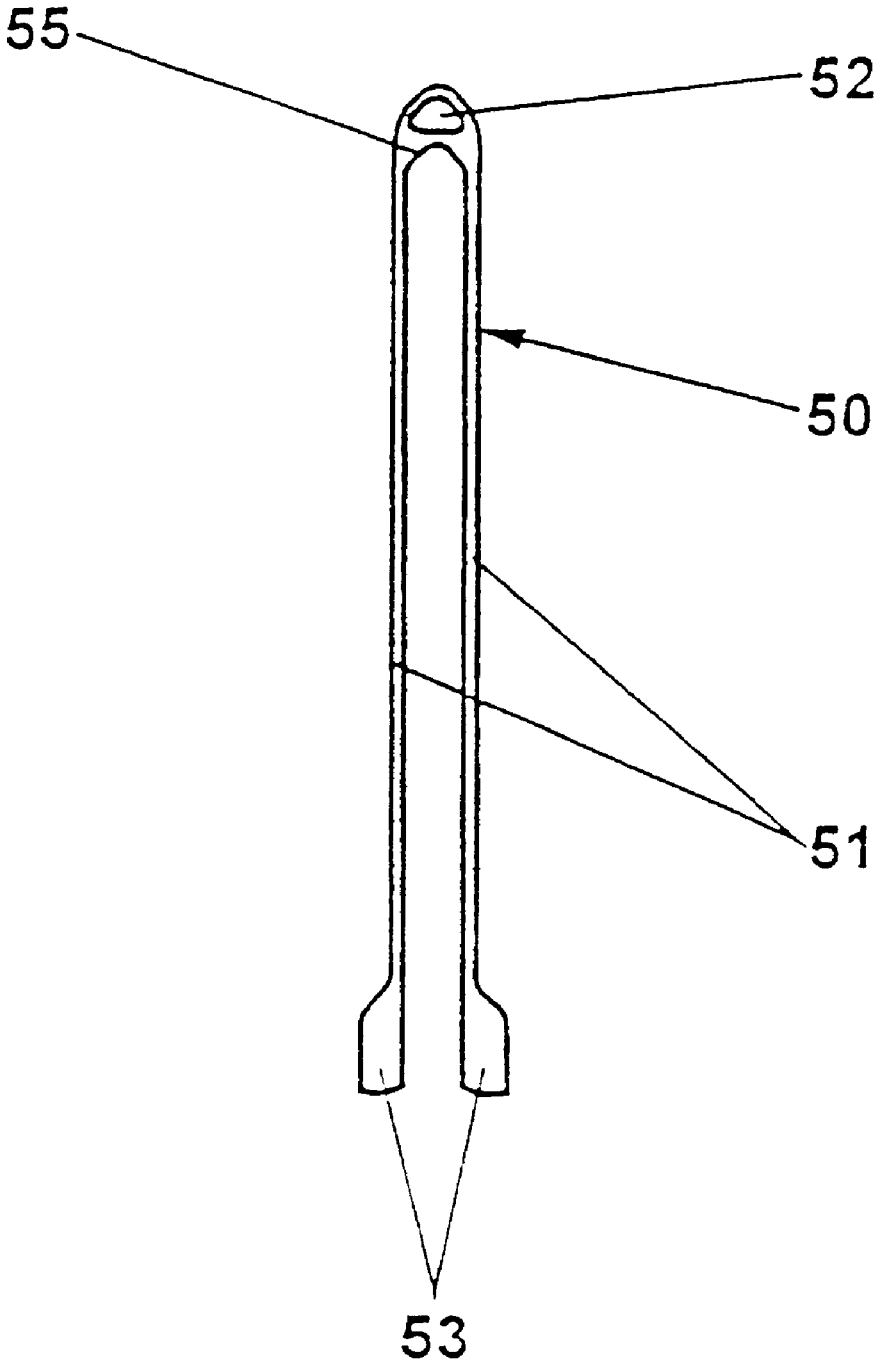
FIG. 4 shows a half heald.

The half heald 50 shown in FIG. 4 has two legs 51 that are converging at their end to an eye 52, whereas a roof-like junction web 55 may be seen underneath the eye. The legs 51 of half heald 50 are provided on their free end with plate-like projections 53.

Figure 3:
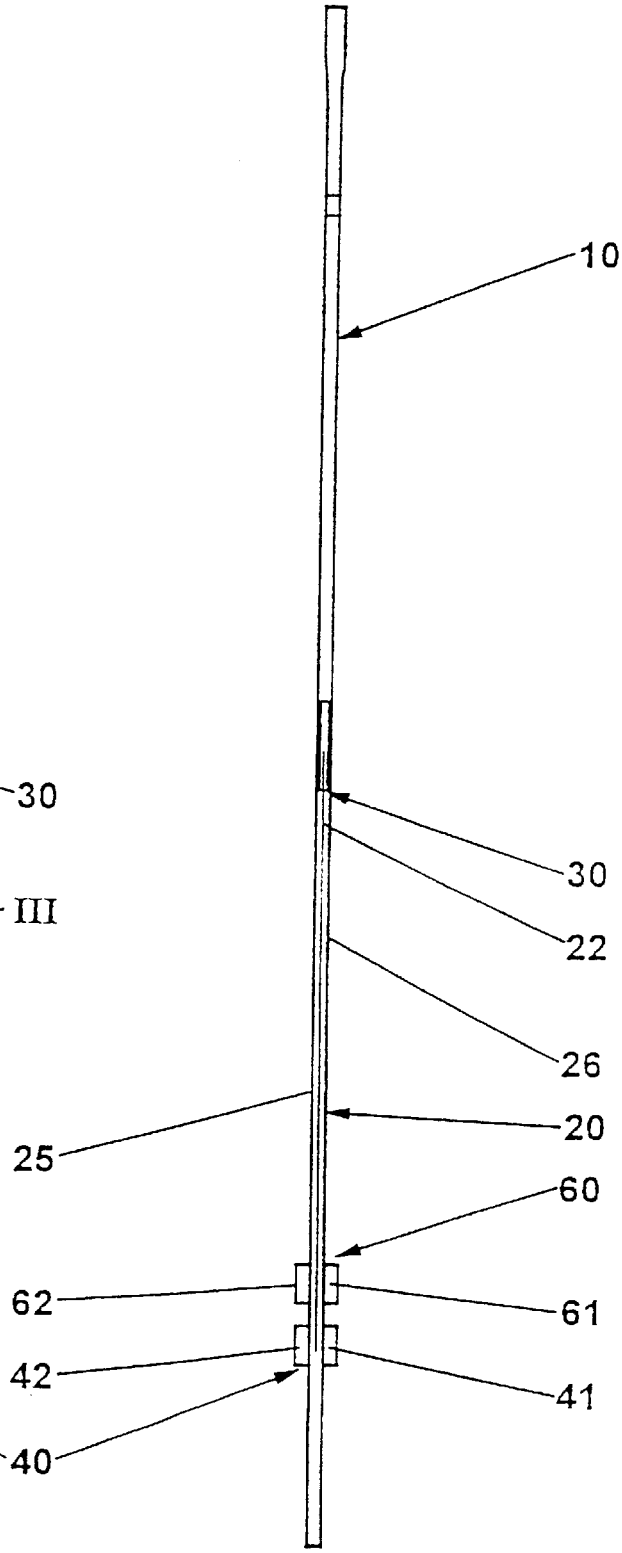
FIG. 3 shows the lifting heald of FIG. 2 seen according to the arrow 3 of FIG. 2.

The leg 20 of the lifting heald 2, 3 shows a slot 22 for the repeated reception of the leg 51 of half heald 50 (FIG. 3). A guide hole 30 is provided at the upper end of leg 20. It constitutes the access to the slot 22 of leg 20. That means that the leg 51 of half heald 50 is guided through this guide hole 30. In the area of this guide hole 30, the leg 20 also has the web 23 on which the roof-like junction web 55 of the half heald is sitting.

In order for the lifting healds 2, 3 to guide the movement of half heald 50, the lifting heald is provided in the lower area of leg 20 with magnets 40 and consists of two magnets 41, 42 arranged in the walls 25, 26 of the lifting healds' 2, 3 leg so as to face each other. Another pair of magnets 60 is placed above the first pair of magnets. This pair of magnets comprises two magnets 61, 62 that are arranged, just as the magnets of the pair of magnets 40, in the walls 25, 26 of the lifting healds' 2, 3 leg 20 so as to face each other. The spacing of the pair of magnets 40 to the web 23 corresponds approximately to the length of the legs 51 of half heald 50. When the legs 51 of the half heald are moved alongside the slot 22 in lifting heald 2, 3 the leg 51 of half heald 50 is first reaching the pair of magnets 60. Since the half heald as a whole is made of magnetic material, the leg 51 is attracted by its plate-like projections 53 by the magnets 61, 62 of the pair of magnets 60 and is slowed down before the half heald is coming to rest with its junction web 55 on the web 23 of the corresponding lifting heald 2, 3. Then, the plate-like projections 53 of the legs 51 of half heald 50 are coming into the area of the pair 40, where these plate-like projections are also attracted by the magnet 41 or 42, retaining the half heald while it is taken along by the corresponding lifting heald 2, 3.

I claim:

1. Lifting heald means (2, 3) for a leno selvedge, said heald means comprising two lifting healds (2, 3) and one half heald (50) alternately taken along by the lifting healds (2, 3), each lifting heald (2, 3) having, at one end, at least one first magnet (41, 42) for guiding the half heald (50) and a web (23) for taking along the half heald (50), and the spacing between the web (23) and the first magnet (41, 42) corresponding approximately to the length of the half heald's (50) legs, characterized in that the lifting healds are each provided with at least one second magnet (61, 62) longitudinally spaced from the first magnet (41, 42) in the direction of the web (23).

2. Lifting heald according to claim 1, characterized in that the lifting heald (2, 3) has two legs (10, 20), one leg (20) of the lifting heald being provided with a slot (22), and the magnets (41, 42 or 61, 62) being arranged in or on the wall (25, 26) of the lifting heald's (2, 3) leg having the slot (22).

3. Lifting heald according to claim 1, characterized in that the second magnet (61, 62) is provided with a smaller magnetic force than the first magnet (41, 42).

4. Lifting heald according to claim 2, characterized in that two first magnets (41, 42;) are provided at the one end of each heald and two second magnets are provided in or on each wall (25, 26) of the lifting heald's (2, 3) leg (20).

* * * * *